US006896549B2

(12) United States Patent
Feuerreiter et al.

(10) Patent No.: US 6,896,549 B2
(45) Date of Patent: May 24, 2005

(54) DEVICE FOR CONNECTING COAXIAL CONDUCTORS TO A PLUG-IN CONNECTOR

(75) Inventors: Franz Feuerreiter, Bad Tölz (DE); Anton Schröcker, München (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/476,940

(22) PCT Filed: Apr. 15, 2002

(86) PCT No.: PCT/DE02/01401

§ 371 (c)(1),
(2), (4) Date: Nov. 4, 2003

(87) PCT Pub. No.: WO02/091527

PCT Pub. Date: Nov. 14, 2002

(65) Prior Publication Data

US 2004/0137789 A1 Jul. 15, 2004

(30) Foreign Application Priority Data

May 4, 2001 (DE) ..... 101 21 762

(51) Int. Cl.[7] ..... H01R 9/05
(52) U.S. Cl. ..... 439/585; 439/579
(58) Field of Search ..... 439/585, 579, 439/610, 98

(56) References Cited

U.S. PATENT DOCUMENTS 4,653,837 A 3/1987 Phillipson et al.
5,267,878 A 12/1993 Shinji et al.
5,382,182 A 1/1995 Shen et al.
5,474,476 A 12/1995 Cheng
5,490,801 A * 2/1996 Fisher et al. ..... 439/585
5,607,325 A * 3/1997 Toma ..... 439/578
5,965,847 A * 10/1999 Tanaka et al. ..... 174/84 R
6,575,784 B1 * 6/2003 Yamada ..... 439/578

FOREIGN PATENT DOCUMENTS

| | | |
|---|---|---|
| EP | 0 290 353 | 10/1988 |
| EP | 0 536 849 | 4/1993 |
| EP | 0 793 296 | 9/1997 |
| EP | 793 297 | 9/1997 |
| EP | 0 902 502 | 3/1999 |
| WO | WO 93/12561 | 6/1993 |

* cited by examiner

*Primary Examiner*—J. F. Duverne
(74) *Attorney, Agent, or Firm*—Bell Boyd & Lloyd LLC

(57) ABSTRACT

A shielded plug-in connector is provided which includes a shield housing on which a cylindrical crimp sleeve is formed. A substantially cylindrical moulded part has partial cylindrical longitudinal grooves into which the exposed shield jackets of coaxial conductors can be inserted. The moulded part can be introduced, together with the coaxial conductors, into the crimp sleeve. The latter is compressed using a serrated crimping tool, whereby the moulded part is deformed in such a way that the longitudinal grooves contract and the shield jackets are tightly encompassed.

4 Claims, 1 Drawing Sheet

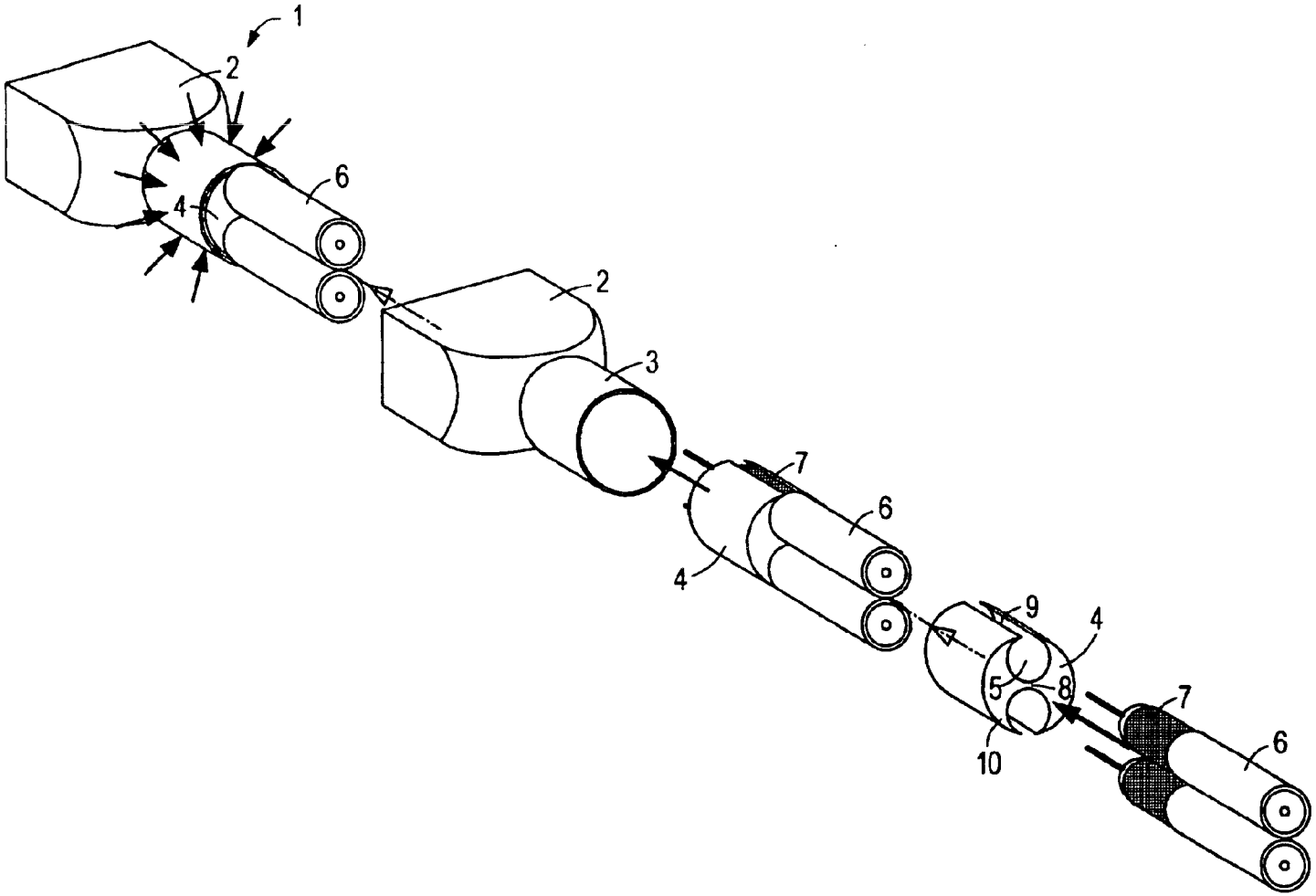
1
2
4
6
2
3
6
7
4
4
8
9
5
10
6
7

DEVICE FOR CONNECTING COAXIAL CONDUCTORS TO A PLUG-IN CONNECTOR

BACKGROUND OF THE INVENTION

The present invention relates to a plug-in connector for connecting coaxial conductors in which shield jackets of the coaxial conductor can be connected to surrounding grounded crimp contacts of the plug-in connector.

This type of device has become known, for example, through EP 0 793 296 A2. According to this reference, a multiway plug-in connector features a ground contact which is provided with crimp tabs at the rear, into which the end sections of each coaxial conductor with exposed shield jackets can be inserted. The plug-in connector is further provided with a grounded shield housing.

Furthermore, WO 9312561 A1 shows a plug-in connector for coaxial conductors with shield jackets exposed in an end section. The back of the plug-in connector features a conducting molded part with longitudinal grooves, which in cross section are partly circular, each of which accommodates one of the exposed end sections of the coaxial conductor. These can, alternately, be secured by a cable tie or by means of two rigid housing sections to be screwed together (140, 142) to further housing sections formed on them (150, 152).

In addition, EP 0902502 A1 (Fig. 3, 7) discloses a plug-in connector for connecting a coaxial conductor with a shield jacket. In the area where the coaxial conductor is introduced into it, the plug-in connector features a crimp sleeve (62) which is rigidly connected to the crimp housing (60). A metallic molded part can be used in the crimp sleeve and, in conjunction with the latter, forms a crimp contact. The shield jacket of the coaxial conductor is not exposed, however.

An underlying object of the present invention is to simplify contacting of the shield jacket and improve the shielding effect.

This object is achieved by the present invention wherein a plug-in connector is provided which includes a molded part designed in such a way that it largely surrounds the individual end sections so that there is resulting contact with the molded part over a large area. The longitudinal groove opening can be kept narrow enough for the crimp sleeves of the shield jacket to make good contact but to still protect them against too much deformation. The groove cross section, of course, does not have to be exactly circular but very often can be polygonal or slightly elliptic. The only important aspect is that, after the molded part is pressed together, a secure all-around contact is established with the matching end section. The crimp sleeve can be designed in such a way that after crimping it is tight against, for example, the extruded or molded part. In this way not only is the strain on the individual coaxial conductors in the insertion area of the plug-in connector securely relieved, but also a high-frequency-proof ground connection is established for the coaxial conductors.

In an embodiment of the present invention, the molded part is allowed to be deformed so that with round crimping the crimp sleeve lies securely against the end section, enabling crimping to be undertaken with a manual crimping tool.

In an alternative embodiment, a direct high-frequency-proof connection is produced between the shield jacket, the molded part and the shield housing.

Additional features and advantages of the present invention are described in, and will be apparent from, the following Detailed Description of the Invention and the Figures.

BRIEF DESCRIPTION OF THE FIGURES

FIG. 1 shows in a perspective exploded view a plug-in connector 1 with connected coaxial conductor 6.

DETAILED DESCRIPTION OF THE INVENTION

The plug-in connector 1 features a surrounding shield housing 2 which is molded into the insertion area of coaxial conductor 6 into a cylindrical crimp sleeve 3. A largely cylindrical molded part 4 is inserted into the crimp sleeve 3 which is provided with partly cylindrical longitudinal grooves 5. The longitudinal grooves 5 are arranged so that between them in a central area there remains a narrow divider 8 so that the longitudinal grooves 5 intersect with the external jacket of molded part 4 to form narrow longitudinal slots 9. Between each longitudinal groove 5 and the outside jacket of molded part 4, wing-shaped tapered protrusions 10 are formed.

For each coaxial conductor 6, a shield jacket 7 is exposed in an end section. The diameter of the longitudinal grooves 5 is, prior to assembly, somewhat larger than the external diameter of shield jacket 7. The coaxial conductors 6 are pushed into longitudinal groove 5 in the direction of the arrow and inserted along with the molded part 4 into the crimp sleeve 3. The crimp sleeve 3 is then pressed together in the direction of the star arrangement of arrows, as shown in FIG. 1, firmly enough for the molded part 4 to deform. When this is done, the protrusions 10 bend inwards so that the longitudinal grooves 5 narrow. Furthermore, the divider 8 is kept thin enough to be compressed at high crimping force and the longitudinal grooves 5 narrow further. The shield jacket 7 is, thus, firmly gripped all around and contacted with the body of the shield housing. With an expanded crimp sleeve it is also possible to provide the enlarged molded part with more than two longitudinal grooves for a larger number of coaxial connectors.

Although the present invention has been described with reference to specific embodiments, those of skill in the art will recognize that changes may be made thereto without departing from the spirit and scope of the present invention as set forth in the hereafter appended claims.

What is claimed is:

1. A plug-in connector for connecting at least one coaxial conductor, wherein an exposed shield jacket of end sections of the coaxial conductor are connected with surrounding grounded crimp contacts of the plug-in connector, comprising:

a shielding housing;

a metallic crimp sleeve in a connector entry area which is rigidly connected to the shielding housing; and a metallic molded part fitted in the crimp sleeve, such that a combination of the metallic molded part and the crimp sleeve forms the grounded crimp contacts;

wherein a cross section of the molded part features partly circular longitudinal grooves which respectively accept one of the exposed end sections of the coaxial conductor, and wherein the crimp sleeve may be compressed to an extent such that the longitudinal grooves of the molded part narrow.

2. A plug-in connector for connecting at least one coaxial conductor as claimed in claim 1, wherein the molded part includes wing-shaped protrusions between an outside surface of the molded part and the longitudinal grooves which may be bent inwards by the crimp sleeve.

3. A plug-in connector for connecting at least one coaxial conductor as claimed in claim 1, wherein the longitudinal grooves are substantially evenly distributed over a circumference of the molded part, and remaining divider parts of the molded part between the longitudinal grooves may be deformed by the crimp sleeve.

4. A plug-in connector for connecting at least one coaxial conductor as claimed in claim 1, wherein the crimp sleeve is a one-piece element of the shield housing.

* * * * *